United States Patent [19]

Yahl

[11] 4,277,411

[45] Jul. 7, 1981

[54] EXTRACTION OF OIL FROM VEGETABLE MATERIALS

[75] Inventor: Kenneth R. Yahl, Orland Park, Ill.

[73] Assignee: CPC International Inc., Englewood Cliffs, N.J.

[21] Appl. No.: 95,743

[22] Filed: Nov. 19, 1979

Related U.S. Application Data

[63] Continuation of Ser. No. 945,268, Sep. 25, 1978, abandoned.

[51] Int. Cl.[3] ..... C11B 1/00

[52] U.S. Cl. ..... 260/412.4; 260/412.8

[58] Field of Search ..... 260/412.4, 412.8

[56] References Cited

U.S. PATENT DOCUMENTS

| | | | |
|---|---|---|---|
| 2,645,650 | 7/1953 | Ayers | 260/412.4 |
| 3,786,078 | 1/1974 | Finley | 260/412.4 |
| 4,008,210 | 2/1977 | Steele et al. | 260/412.4 |

*Primary Examiner*—John F. Niebling

*Attorney, Agent, or Firm*—Stanley M. Parmerter

[57] ABSTRACT

An improved method for extracting oil from oil-bearing vegetable materials is disclosed. The method comprises forming a particulate vegetable material containing between about 20% and about 55% water by weight, drying the particulate vegetable material to a moisture content of less than about 15% by weight and then extracting the dried material with an oil solvent.

6 Claims, No Drawings

EXTRACTION OF OIL FROM VEGETABLE MATERIALS

This is a continuation of copending application Ser. No. 945,268, filed Sept. 25, 1978 now abandoned.

BACKGROUND OF THE INVENTION

There are numerous known methods for extracting oil from vegetable materials. One technique in commercial use, for example, involves continuously pressing the vegetable material at low moisture content to expel oil. A pretreatment steaming of the vegetable material is frequently employed to facilitate the pressing operation. In addition, it is common to employ a subsidiary step of solvent extracting the pressed material to remove residual oil.

Unfortunately, these processes possess a number of drawbacks. In particular, the expelling operation requires heavy machinery and results in a substantial rise in temperature harmful to oil and vegetable protein qualities and further tends to produce large quantities of vegetable fines which must be separated from the expelled oil.

Other techniques designed to circumvent these drawbacks have been found. These include the processes set forth in Canadian Pat. No. 763,968 and U.S. Pat. No. 3,786,078. Both of these patented processes involve direct extraction of the vegetable material with an oil solvent. Because of their respective requirements of severe operating conditions, extraction of finely divided material and/or complex pretreatments of the oil-bearing vegetable material, however, they have not proven altogether successful.

It is therefore an object of this invention to provide a simplified process for recovery of oil from vegetable materials.

It is a further object to provide an oil extraction process which does not require subjection of the oil or vegetable material to deleterious conditions of operation.

It is a still further object to provide a process which permits essentially complete recovery of oil from a variety of vegetable materials.

Another object is to provide a process which does not release finely divided material into the oil solvent.

These and various other objectives, as are apparent from the description which follows, are achieved through the present invention.

DESCRIPTION OF THE INVENTION

The process of the present invention provides an improved method for extracting oil from oil-bearing vegetable materials. The method comprises forming a particulate vegetable material containing between about 20% and about 55% water by weight, drying the particulate vegetable material to a moisture content of less than about 15% by weight and then extracting the dried material with an oil solvent.

In a preferred embodiment of the invention, the particulate vegetable material is formed by compressing the oil-bearing vegetable material, containing between about 20% and about 55% water by weight, by passing it between rolls under pressure sufficient to rupture the oil-containing cells without expelling the oil from said vegetable material.

The process of this invention can be applied to all oil-bearing vegetable materials. It is especially suitable for application to those materials of relatively high oil content such as decorticated sunflower seed, decorticated cottonseed and the germ obtained by the wet milling of corn. This novel procedure is particularly well suited to the extraction of oil from corn germ. Accordingly, the description which follows is largely exemplary with respect to this particular vegetable seed material.

The first step of the present process may be accomplished by passing moist, oil-bearing vegetable material between the rolls of a flaking machine. While smooth or corrugated rolls may be used, the corrugated roll grooves tend to become plugged with the wet material and so are less satisfactory. The rolls may be of the same or different diameters, and the rolls of the machine may rotate at the same or at different speeds.

When dried corn germ is passed through flaking rolls under pressure, large flakes are obtained and relatively large amounts of energy are required to operate the rolls so as to obtain flakes of the 0.15 to 0.5 mm thickness required for nearly complete oil extraction. When wet corn germ is passed through the flaking rolls, surprising differences are observed. It requires much less energy to pass wet germ than it does to pass dry germ through the rolls even when they are set closer together to give a product of less than 0.05 mm thickness which is required for this process. Further, the product is obtained as small, stringy particles rather than flakes. The pressure in this process must be sufficient to flatten the particles and rupture the oil-containing cells so that the oil can be easily extracted with an oil solvent. Surprisingly, essentially no free oil is apparent in the shredded germ. An additional unexpected result of this process is that the oil-containing particles are disrupted so that they release the oil content without the production of fines which are so difficult to separate from the oil obtained in the previously known grinding and extraction processes. These fines have been a particularly serious problem when corn germ has been flaked or milled at low moisture content.

Although it is most economical to use undried oil-bearing material such as undried wet-milled corn germ in the practice of this process, other starting materials may also be used. A dried vegetable material may be converted to a higher moisture product by mixing with a suitable amount of water or other moistening agent. This mixture should contain between about 20% to about 55%, preferably 25% to 50%, of water by total weight.

The nature of the moistening agent employed to rehydrate the vegetable material is not critical. Water alone or other moistening agents may be used. In a preferred embodiment, however, the moistening agent is light steepwater (the unconcentrated liquor recovered from wet milling of corn).

In an alternative embodiment, one may use a mixture of the dried and undried oil-bearing vegetable material, for example, a mixture of undried and dried wet-milled corn germ. This mixture may be blended and additional wetting agent added as needed to obtain the desired moisture level before the material is passed between the flaking rolls.

Suitable material for extraction can be obtained using any conventional flaking apparatus with the rolls pregapped to a distance suitable to obtain the desired pressure on the material. We have found that in the case of the Ferrell-Ross flaking rolls, 12×12-inch, Ser. No. 4798, Ferrell-Ross Inc., Minneapolis, Minn., the rolls should be pre-gapped at less than 0.05 mm to give a suitable product. The Allis-Chalmers laboratory flaking rolls (6×6-inch, Ser. No. 1067), Allis-Chalmers, Milwaukee, Wisc., gave a satisfactory product when the roll pressure was set at the highest setting, 6.0. Samples may be passed through the rolls two or more times as needed in a particular apparatus to produce a product with the desired extractability.

Other equipment may be used for compressing the vegetable material. However, the pressure must be sufficient to rupture the oil-bearing cells to give a product with the desired extractability without expelling the oil from the material.

The second essential step of the process is the drying of the moist material which has passed through the rolls. In order to obtain a product that gives good oil extraction, the moisture content must be reduced to less than about 15%, preferably less than about 5%, by weight. This may be accomplished in any conventional drying equipment, such as an air oven or belt dryer. The dried, pressed material has a bulk density of less than 0.3, usually about 0.2 grams per cubic centimeter.

Extraction of the dry, oil-bearing vegetable material may be preferred with any of the conventional oil solvents. Typically, however, the solvent is a liquid hydrocarbon such as hexane.

The mode and apparatus utilized for extraction may likewise be selected from among those conventional in the art. Counter-current, column or percolation extractors may be operated in either batch or continuous manner as desired.

After extraction has been completed, the residual meal will generally exhibit an oil content of less than 5%, preferably less than about 2%, by weight. This material, which has a high protein content, may be freed of solvent by evaporation and used as animal feed or the like.

The oil is separated from the solvent, using conventional equipment. The oil may be further treated as desired using any one or a combination of the customary steps of refining, bleaching and deodorizing to produce a high-grade, edible vegetable oil.

Previous processes which have employed extraction of oil from finely ground vegetable material have been costly. The finely divided material has so impeded the flow of solvent through the solids that extraction was very slow. In addition, the extract has been contaminated by the accumulation of very small protein bodies of about 1 micron in diameter. It has been difficult and costly to remove the contaminants from the extract.

The present process overcomes these difficulties by producing a material through which the extraction solvent flows readily. In addition, any particles that do pass into the extract are large enough to permit easy removal by settling or filtration.

Although the foregoing process has been described chiefly in terms of a complete process for extracting the oil from essentially naturally occurring forms of vegetable material, it is not so limited. This process may be used in combination with other conventional steps in oil extraction and by-product recovery.

Throughout the present process and any preliminary steps of treatment of the vegetable material, it is preferred that conditions deleterious to the oil in the vegetable material be minimized or avoided. Of these conditions, elevated temperatures are the most serious. Such temperatures, unless for a very brief time, can cause the quality of the oil to suffer. In view of this, it is generally desirable to maintain moderate temperatures to limit exposure to elevated temperatures to as short a time as possible and to maintain an inert atmosphere throughout the processing of the vegetable material and its oil. This is particularly true during the drying step.

The following examples illustrate certain embodiments of the present invention. Unless otherwise stated, all proportions and percentages are provided on the basis of weight.

EXAMPLE I

Undried, full-fat corn germ (about 55% moisture) obtained from the wet milling of corn was passed through the smooth rolls of an Allis-Chalmers Laboratory Flaking Rolls, 6×6-inch rolls, Ser. No. 1067, made by the Allis-Chalmers Co., Milwaukee, Wisc. The rolls were operating at a 1:1 gear speed with pressure applied to the rolls. The material was passed through the rolls twice.

One portion of the material was dried to about 5% moisture before extraction with hexane. A second portion was extracted with hexane without drying.

The hexane extraction was performed by the method described in J. Am. Oil Chemists' Soc. 26, 422 (1949). A Butt type extractor was used with a reflux rate of about 18 ml per minute. Residual oil was determined by the Spex mill method. In this method, the sample is placed with carbon tetrachloride in a small ball mill (Spex mixer mill, Catalog No. 8000) made by Spex Industries, Inc., Metuchen, N.J., and shaken thoroughly to disintegrate the meal. The ground slurry is heated for 30 minutes under reflux with carbon tetrachloride and filtered. The oil content of the filtrate is determined after evaporation of the solvent.

Results, given in Table I, show that oil extraction is more complete when the germ is dried before extraction. In addition, a higher pressure setting on the rolls gives a product from which the oil is more completely extracted.

TABLE I

| Roll Pressure[1] | Moisture (%) of Material Before Extraction | Extraction Time (Min) | Oil (%) In Residue |
|---|---|---|---|
| 5.3 | 52.8 | 50 | 19.2 |
| 5.3 | 4.8 | 50 | 8.4 |
| 5.6 | 52.0 | 50 | 12.7 |
| 5.6 | 52.0 | 90 | 9.7 |
| 5.6 | 6.5 | 50 | 4.7 |

[1]Arbitrary numbers on pressure scale - Allis-Chalmers Laboratory Flaking Rolls.

EXAMPLE II

Undried corn germ was treated generally as set forth in Example I. The compressed product was dried at various temperatures before oil extraction.

Results, given in Table II, show that increased roll pressure aids oil extraction and that drying the product at temperatures up to 120° C. gives material from which the oil is readily extracted.

TABLE II

| Roll Pressure[1] | Drying Temperature (°C.) | Moisture (%) of Material Before Extraction | Oil in Residue (%) Extraction Time (Min) 50 | 90 |
|---|---|---|---|---|
| 5.6 | 25 | 6.7 | 4.6 | 3.8 |
| 5.6 | 70 | 5.4 | 3.5 | 2.8 |
| 5.6 | 100 | 4.0 | 3.3 | 2.5 |
| 5.6 | 120 | 3.7 | 3.8 | 3.3 |
| 6.0 | 25 | 6.7 | 2.1 | 1.9 |

TABLE II-continued

| Roll Pressure[1] | Drying Temperature (°C.) | Moisture (%) of Material Before Extraction | Oil in Residue (%) Extraction Time (Min) 50 | 90 |
|---|---|---|---|---|
| 6.0 | 70 | 6.1 | 1.4 | 1.0 |
| 6.0 | 100 | 5.8 | 1.0 | 0.9 |
| 6.0 | 120 | 3.7 | 2.0 | 1.6 |

[1]Arbitrary numbers on pressure scale - Allis-Chalmers Laboratory Flaking Rolls.

EXAMPLE III

Wet-milled corn germ (49% moisture) was passed through the Ferrell-Ross flaking rolls two times. The rolls were run at room temperature at a hydraulic pressure of 28 kg/cm$^2$ (400 psi) and with a pregap setting of 0.041 mm (0.0016 inch). One roll ran at 1010 rpm, the other at 446 rpm.

A sample of the rolled germ was dried to 2.8% moisture in a circulating air oven at 100° C. The solid was extracted with hexane for 60 minutes and the residual oil content was determined according to the method given in Example I. The oil content of the residue was 2.3%.

I claim:

1. A process for extracting oil from essentially whole corn germ obtained by the wet milling of corn consisting essentially of the steps of: shredding the germ, containing between about 25% and about 55% water by weight, by passing it between rolls under pressure; directly drying the shredded germ to a moisture content of less than about 15% by weight; and extracting said dried shredded germ with an oil solvent.

2. The process of claim 1, wherein the rolls are less than 0.05 mm apart.

3. The process of claim 1, wherein the shredded germ is less than 0.05 mm in thickness.

4. The process of claim 1, wherein the whole corn germ is dry corn germ hydrated with a moistening agent.

5. The process of claim 1, wherein the oil solvent is hexane.

6. The process of claim 4, wherein the moistening agent is light steepwater.

* * * * *